US007540637B1

(12) United States Patent
Williams

(10) Patent No.: US 7,540,637 B1
(45) Date of Patent: Jun. 2, 2009

(54) UTILITY MOUNTING AND LOWERING SYSTEM

(76) Inventor: Kenneth Riley Williams, 7550 Williamsburg Dr., Cumming, GA (US) 30041

( * ) Notice: Subject to any disclaimer, the term of this patent is extended or adjusted under 35 U.S.C. 154(b) by 221 days.

(21) Appl. No.: 11/526,253

(22) Filed: Sep. 25, 2006

Related U.S. Application Data

(63) Continuation-in-part of application No. 11/120,449, filed on May 4, 2005, now Pat. No. 7,393,124.

(51) Int. Cl.
*F21V 21/36* (2006.01)

(52) U.S. Cl. ..... 362/403; 362/404; 362/425; 362/147; 254/285; 248/320

(58) Field of Classification Search ..... 362/403, 362/404, 407, 425, 402, 385, 147, 148, 150, 362/572, 575, 648, 401, 406
See application file for complete search history.

(56) References Cited

U.S. PATENT DOCUMENTS 576,058 A * 1/1897 Philbrick ..... 248/320
586,435 A * 7/1897 Haney ..... 248/320
589,881 A * 9/1897 Warner ..... 248/320
4,057,211 A * 11/1977 Moore ..... 248/332
5,420,772 A * 5/1995 Evans ..... 362/386
5,519,597 A * 5/1996 Tsai ..... 362/386
6,142,824 A * 11/2000 Savoca et al. ..... 439/531
6,316,847 B1 * 11/2001 Crockett ..... 307/125
2006/0180564 A1 * 8/2006 Keppel ..... 212/330

* cited by examiner

*Primary Examiner*—Ali Alavi
*Assistant Examiner*—Evan Dzierzynski
(74) *Attorney, Agent, or Firm*—Kenneth E. Darnell

(57) ABSTRACT

A mounting and lowering system for supporting one or more luminaires or similar devices having use within an indoor space or similarly configured space such as an open-air pavilion or the like, the system comprising a support assembly capable of being raised and lowered above a location within such a space not conveniently available for use in the servicing of luminaires or devices mounted by the system. The present system includes a latching mechanism permitting remote latching and unlatching of the support assembly. Vertical displacement of the support assembly can be effected without power interruption. Primary drive components are positioned within the system to facilitate service and replacement. The invention further contemplates transition apparatus capable of use in indoor spaces having differing ceiling angles.

19 Claims, 14 Drawing Sheets

UTILITY MOUNTING AND LOWERING SYSTEM

CROSS-REFERENCE TO RELATED APPLICATION

This application is a continuation-in-part of U.S. patent application Ser. No. 11/120,449, filed May 4, 2005, now U.S. Pat. No. 7,393,124 for "Architectural Mast-Mounted Support System".

BACKGROUND OF THE INVENTION

1. Field of Invention

The invention relates generally to systems for hoisting utilitarian devices between use and service positions and particularly to such systems wherein a luminaire or cluster of luminaires are raised and lowered between use and service positions within an indoor or similar facility.

2. Description of the Prior Art

Luminaires and other utilitarian devices are often mounted indoors in dwellings, commercial and industrial buildings and even within the confines of structures such as open-air pavilions and the like in situations wherein access to the luminaires or other devices is impeded. In such situations, maintenance and repair are difficult due to the disposition of furniture, equipment and/or machinery inter alia directly below such luminaires or similar devices obviate the use of lift devices, ladders or the like for maintenance of such devices. In domestic situations, chandeliers or similar lighting fixtures are often mounted in spaces having furnishings and the like directly below such lighting fixtures, maintenance and lamp replacement not being possible except in a lowering of such fixtures to a height enabling access to the fixture or fixtures. Similarly, commercial situations such as retail stores, warehouses and the like have display cases, elevated shelving and other equipment located below lighting fixtures and other utilitarian devices with a result that access to such devices is difficult through use of ladders and the like especially in situations wherein the devices are located at substantial heights above the floor of such spaces. Industrial situations wherein machinery including chemical processing equipment and the like are located below luminaires mounted at heights above such machinery present additional though similar problems. In all such situations, personal safety must be considered when ladders and other expedients are used that require repair or maintenance personnel to ascend to the "in use" position of the lighting fixtures or other utilitarian devices mounted at heights above floor levels.

Systems intended to address the problems inherent in maintaining luminaires and the like in situations such as are noted herein have been devised previously, one such system being available from Aladdin Light Lift Incorporated for lowering chandeliers and the like, this system having all active components thereof mounted above a ceiling. Glebe, in U.S. Pat. No. 5,556,195 discloses a motorized system for lowering a luminaire from an "in use" position at or near a ceiling of a room to a maintenance position at or near a floor immediately below the "in use" position, the system including a cable to which a luminaire is connected and which is movable by an electric motor mounted above or on a ceiling. Glebe is distinguished from the Aladdin system by the ability of the Glebe system to function without interruption of electrical power to a winch/motor used to lower and then raise the luminaire in need of maintenance, repair or replacement. Pfaff, Jr., in U.S. Pat. No. 3,610,584, similarly discloses a luminaire lowering system wherein active lowering mechanisms are located above a ceiling as does Falls et al in U.S. Pat. No. 5,105,349 and Evans in U.S. Pat. No. 5,420,772. In these systems, service of active components of the lowering systems themselves is difficult due to the location of the active components such as motors, switches and electrical and mechanical connections inter alia either in enclosed locations above ceilings or in locations difficult to access for reasons similar to inability to access luminaires or the like such as initially requires use of these lowering systems. Lowering systems of varying description are also disclosed by Sakurai in U.S. Pat. No. 4,381,539; by Mier-Langner et al in U.S. Pat. No. 6,843,581 and by Weinhuber in U.S. Pat. No. 6,758,581. The prior art as represented by the foregoing systems as disclosed in the listed patents and as practiced in the disclosed systems are configured such that active components of such lowering systems are difficult to access for maintenance and repair. Further, lowering systems of the prior art as represented by the patents and systems referred to above are not susceptible to ready retrofit in existing buildings and, in any event, are configured to be disposed in essence only above or at a ceiling of a building. Still further, the lowering systems of the prior art do not provide positive latchment of one or more luminaires such as can be mountable to a lowering box or the like so that the luminaire or luminaires are mounted with an exceptional degree of stability when disposed in the "in use" position at or near a ceiling of a building. The prior art therefore remains in need of a lowering system useful in environments as referred to herein and which yields solution to previously unaddressed or unresolved problems inherent in the use of prior lowering systems, the present invention addressing such problems in a novel lowering system for single or multiple luminaires or similar utilitarian devices as disclosed herein. The present invention further addresses the need to accommodate mechanical elements of the present lowering systems to ceiling configurations having differing angles.

SUMMARY OF THE INVENTION

The invention provides hoisting systems for lowering a luminaire or clusters of luminaires mounted to a support frame in a ceiling of a building so that maintenance, repair or replacement can occur at a position at or near the floor of a building, the systems being particularly usable within buildings having ceilings or other structure from which said luminaire or luminaire-supporting structure is mounted in an "in use" position. The systems of the invention can be used with suspended, recessed or surface-mounted luminaires inter alia and with utilitarian devices other than luminaires. Buildings within which the present systems can be utilized include dwellings, commercial buildings and industrial buildings as well as open-air pavilions and the like, such structures typically having ceiling or roof structure to which a luminaire or other device is normally mounted. The systems of the invention further provide variable angle transition apparatus capable of causing mechanical elements to follow ceilings of differing configurations.

The systems of the invention find particular use in indoor environments and include winch and cable arrangements operable by motive power devices such as electrical motors, air motors and the like. Winch and motive power devices as used in the present systems are typically disposed on interior surfaces of walls of the buildings in which the systems are used, such drive systems of the systems also being positionable within such walls or externally of the buildings such as on exterior walls thereof. In open-air pavilions, such drive systems can be mounted to a suitable support plate or contained within a suitable housing. Drive systems of the present invention connect to a luminaire or cluster of luminaires or the like through wire cables that are caused to follow pulley and sheave arrangements, distal ends of such cables being connected to a luminaire-bearing support frame that mounts the luminaire or luminaires in a use position and being lowered on activation of the drive systems to displace said luminaire or luminaires to a maintenance position at or near a floor of the building. Cables including electrical power cables typically are disposed within conduit mounted against wall and ceiling surfaces, housings for the pulley and sheave arrangements connecting to such conduits being capable of modification to accommodate ceilings of differing configuration.

The support frame of the present lowering systems includes mechanisms capable of releasably and positively latching to cooperating structure carried by a stationary head frame permanently fixed to building structure at or near a ceiling, such structure comprising a latching mechanism employed to maintain the movable support frame to the stationary head frame when in a use position. The latching mechanism includes at least one cam-following pin slidable within a pin housing and mounted to the movable support frame, the pin engaging camming surfaces formed in a cam plate fixed to the stationary head frame. Each pin engages the camming surfaces on raising of the support frame into latching relation with the head frame, the pin sliding within the pin housing to assume a position whereby the support frame latches to the head frame. The support frame is raised slightly preparatory to lowering thereof by action of the motive power devices acting through the cables to disengage the support frame from the head frame, the support frame then being controllably lowered to a maintenance position near the floor so that luminaires or other devices mounted to the support frame can be maintained, repaired or replaced as necessary.

Latching mechanisms useful according to the invention can take forms other than referred to hereinabove. However, a particular latching mechanism preferably used according to the invention finds particular utility in that this latching mechanism is unlikely to jam during latching and unlatching operation. Use of the latching mechanism according to preferred embodiments of the invention more positively mounts the support frame and the luminaire or luminaires mounted thereto and thereby render an installation more safe.

Lowering systems configured according to the invention permit more ready access to motive power devices such as motors, winching devices and the like for service, replacement or repair being facilitated due to location of such devices in preferred embodiments at permanent positions at or near floor level proud of a wall of a building or interiorly of such a wall or even exteriorly of a wall. By so disposing the motive power devices at such locations, the present systems can be more easily used in retrofit situations.

The lowering systems of the invention find particular use in buildings wherein that floor space below the luminaire or other device mounted at or near ceilings is not accessible through use of ladders or lift systems. Such situations include in relatively simple forms a chandelier or the like disposed above a dining table or above stairs in a stair well. In commercial situations, luminaires or the like can be disposed over retail displays or elevated shelving in warehouses or the like. Industrial situations in which the lowering systems of the invention find particular utility include manufacturing facilities wherein machinery not readily movable is disposed below such luminaires. Particular situations include chemical processing plants such as petrochemical plants wherein explosive materials being processed require use of air motors rather than electrical motors as preferred motive power devices. The present systems thus find particular utility in hazardous locations.

Accordingly, it is an object of the invention to provide lowering systems particularly intended for indoor applications wherein a luminaire or similar utilitarian device can be lowered from an "in use" position at or near a ceiling to a maintenance position at or near a maintenance position below said "in use" position.

It is another object of the invention to provide a lowering system particularly intended for indoor applications whereby a luminaire or cluster of luminaires or similar utilitarian devices mounted to a support frame engaged to a stationary head frame located at or near a ceiling of a building can be released from the head frame and lowered to a maintenance position below an "in use" position, raising of the support frame to engage the head frame permitting positive latching of said frame together by means of a latching arrangement having a high degree of operational reliability.

It is a further object of the invention to provide lowering systems wherein motive power devices used to lower luminaires or similar utilitarian devices from an "in use" position above a building floor to a maintenance position at or near the floor are disposed on, in or exteriorly to a building wall.

It is yet another object of the invention to provide variable angle transition apparatus capable of housing pulley and cable arrangements necessary for operation of the present lowering systems to permit accommodation of ceiling conformations of differing configuration.

Further objects and advantages of the invention will become more readily apparent in light of the following description of the preferred embodiments of the invention.

BRIEF DESCRIPTION OF THE DRAWINGS

FIG. 9 is an elevational view of a lowering system configured according to the invention wherein the system is used in a building having a vaulted ceiling, the building being a hazardous location such as for processing of petrochemicals or the like;

DESCRIPTION OF THE PREFERRED EMBODIMENTS

The disclosures of U.S. Pat. Nos. 3,610,584; 5,556,195; 5,105,349 and 5,420,772 are incorporated hereinto by reference. The disclosure of U.S. patent application Ser. No. 11/120,449, filed May 4, 2005 and entitled "Architectural Mast-Mounted Support System", of which the present application is a continuation-in-part, is incorporated hereinto by reference.

Figure 1:
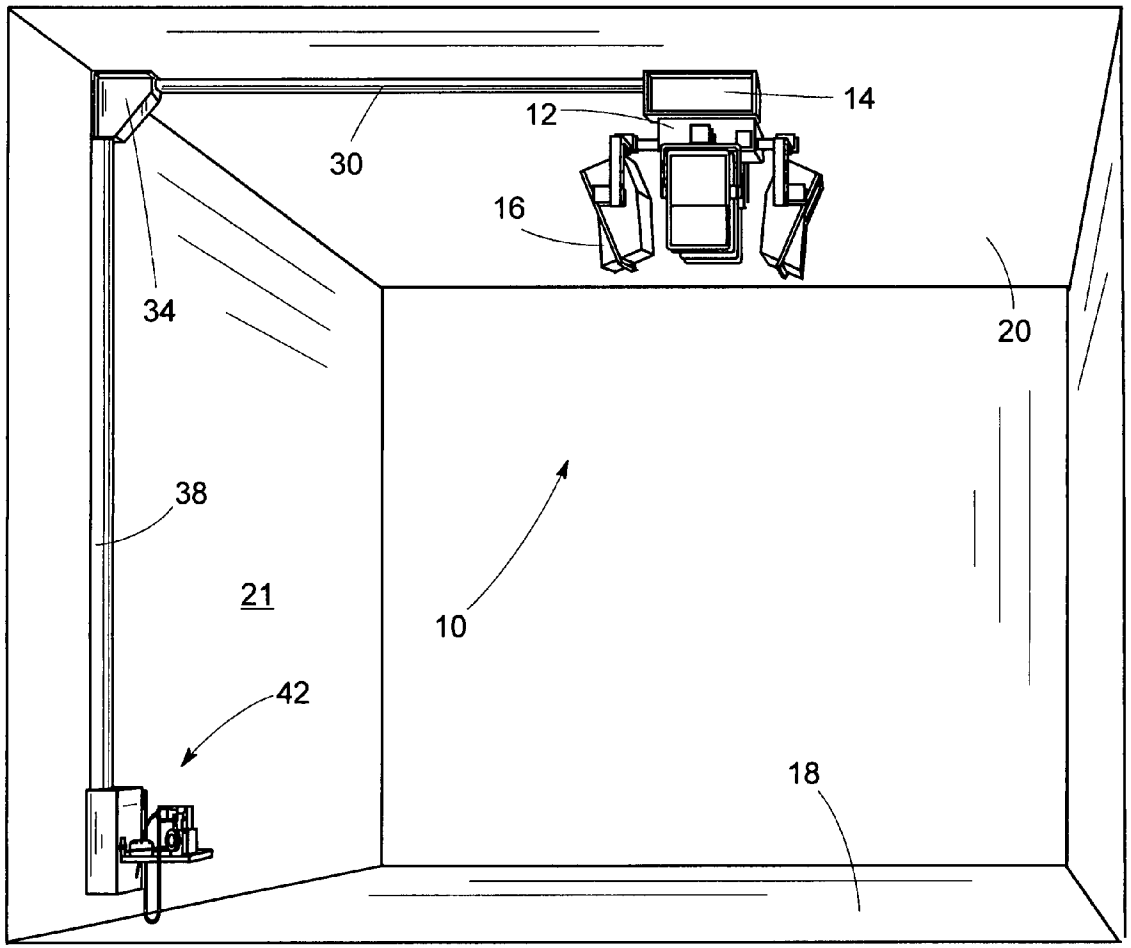
FIG. 1 is a perspective view of a lowering system configured according to the invention wherein the system is used in a building having a flat ceiling.

Referring now to the drawings and particularly to FIG. 1, a lowering system configured according to a first embodiment of the invention is seen at 10 to be comprised of a movable support frame 12 releasably latched to a stationary head frame 14, the support frame 12 having one or more luminaires 16 mounted thereto and movable with the support frame 12 from an "in use" position as shown to a maintenance position below the "in use" position to a position at or near floor 18. The head frame 14 is fixed to a ceiling 20 by means of suitable expedients (not shown) or to suitable structural elements (not shown) such as are conventionally disposed above a ceiling such as the ceiling 20. The ceiling 20 is seen to be disposed at right angles to walls 21 of the space within which the system 10 is located.

The support frame 12 can mount utilitarian devices other than luminaires including speakers, heating and/or ventilation apparatus inter alia. Luminaires can be mounted to support arms or suspended from the support frame 12, recessed thereinto or surface-mounted to said frame 12. The support frame 12 can be configured to mount multiple luminaires or other utilitarian devices and functions with remaining portions of the lowering system 10 to lower the luminaires 16 and the like from an "in use" position at or near the ceiling 20 to a maintenance position at or near the floor 18 especially in operational situations wherein objects such as furnishings, equipment or machinery located beneath the luminaires 16 prevent use of ladders, lifts and the like to maintain the luminaires 16 and the like when located in the "in use" position.

The luminaire-bearing support frame 12 latches to the stationary head frame 14 by means of a latching assembly 24 not shown in FIG. 1 but described in detail hereinafter, the latching assembly 24 preferably being identical with or similar to the latching mechanism disclosed in the aforementioned United States patent application incorporated hereinto by reference and of which the present patent application is a continuation-in-part.

Figure 2:
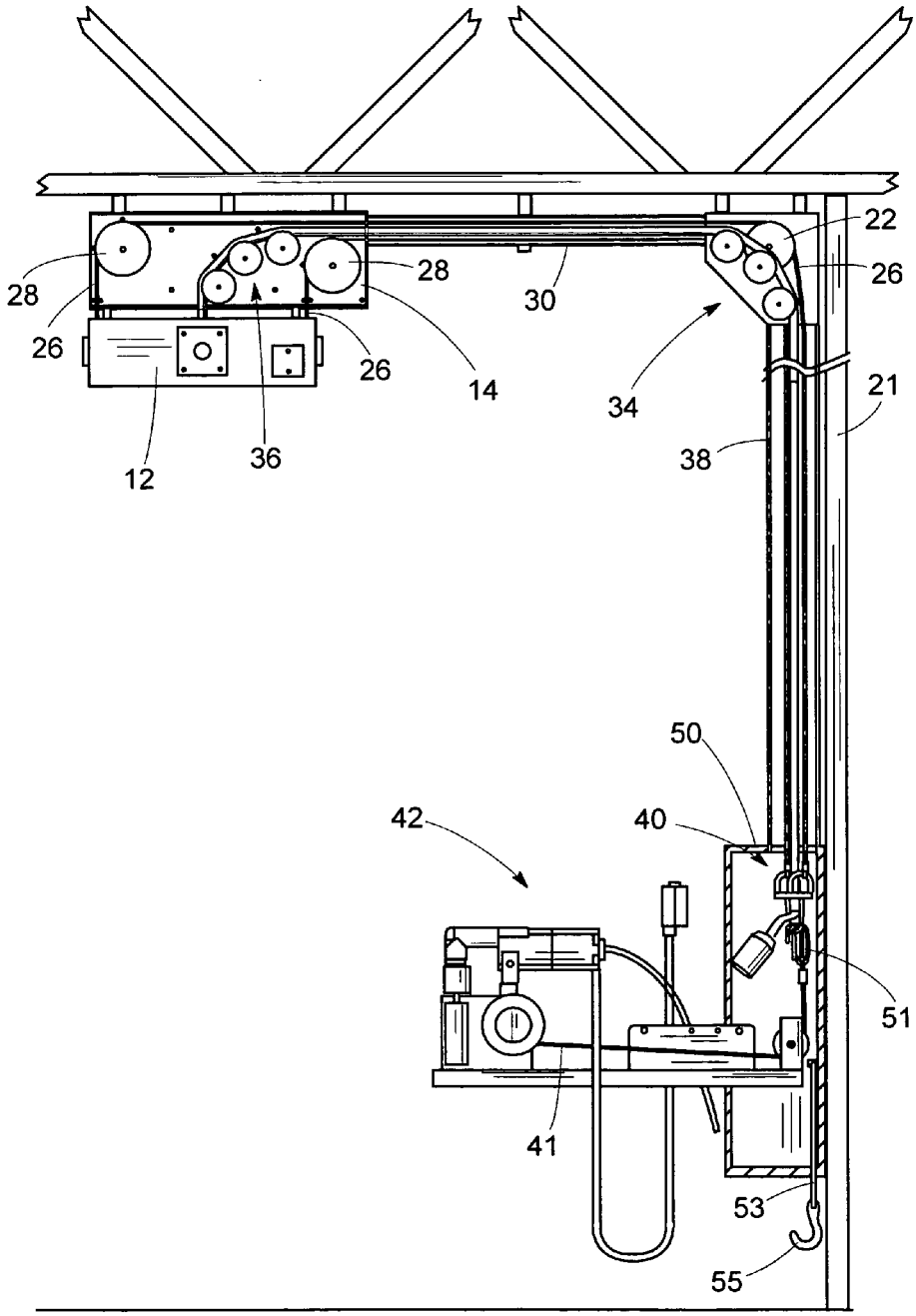
FIG. 2 is an elevational view in section of a lowering system driven by an electrical motive power arrangement.
Figure 5:
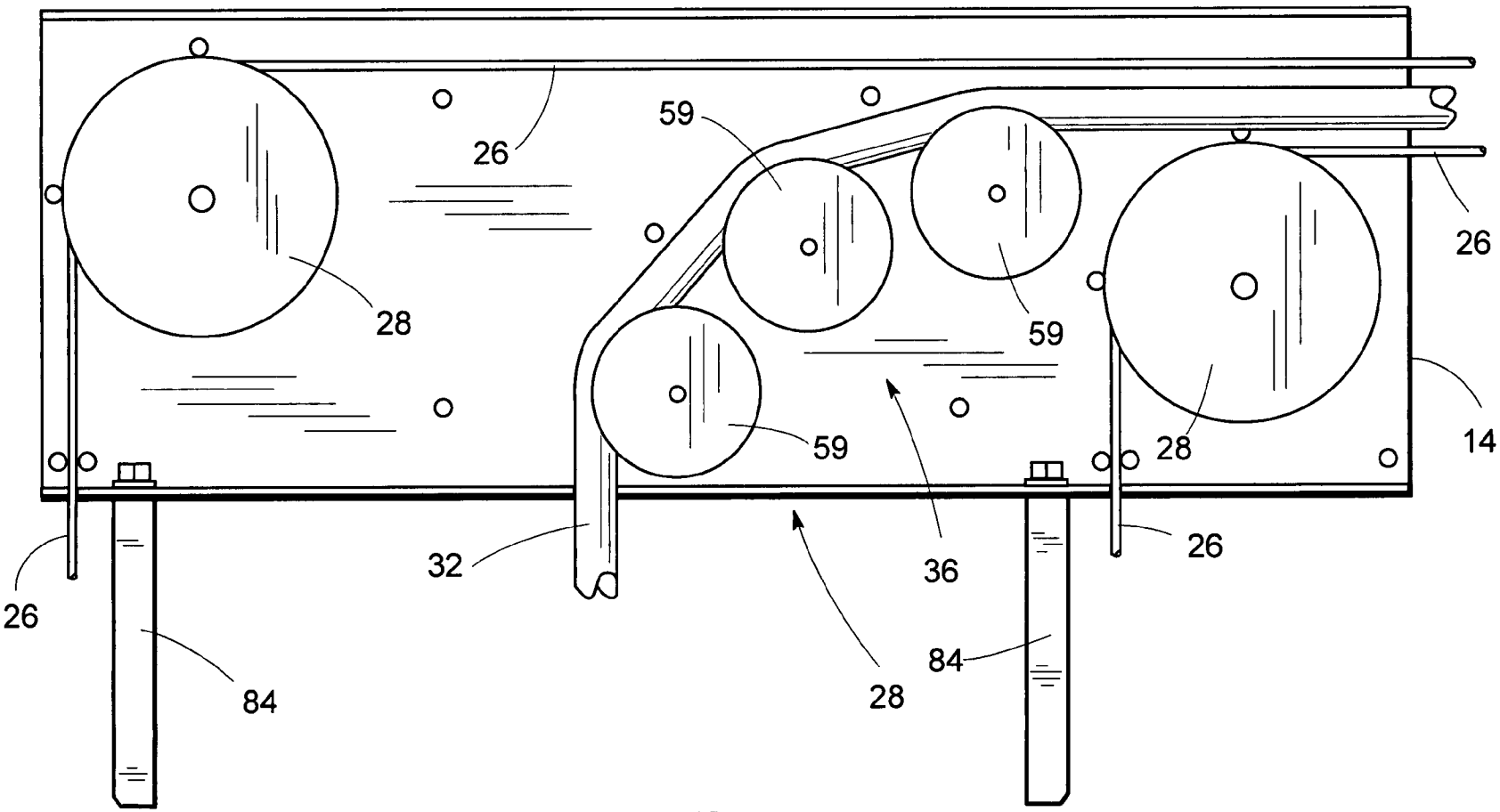
FIG. 5 is a detail view in section of a stationary head frame of the lowering system of FIG. 2.
Figure 6:
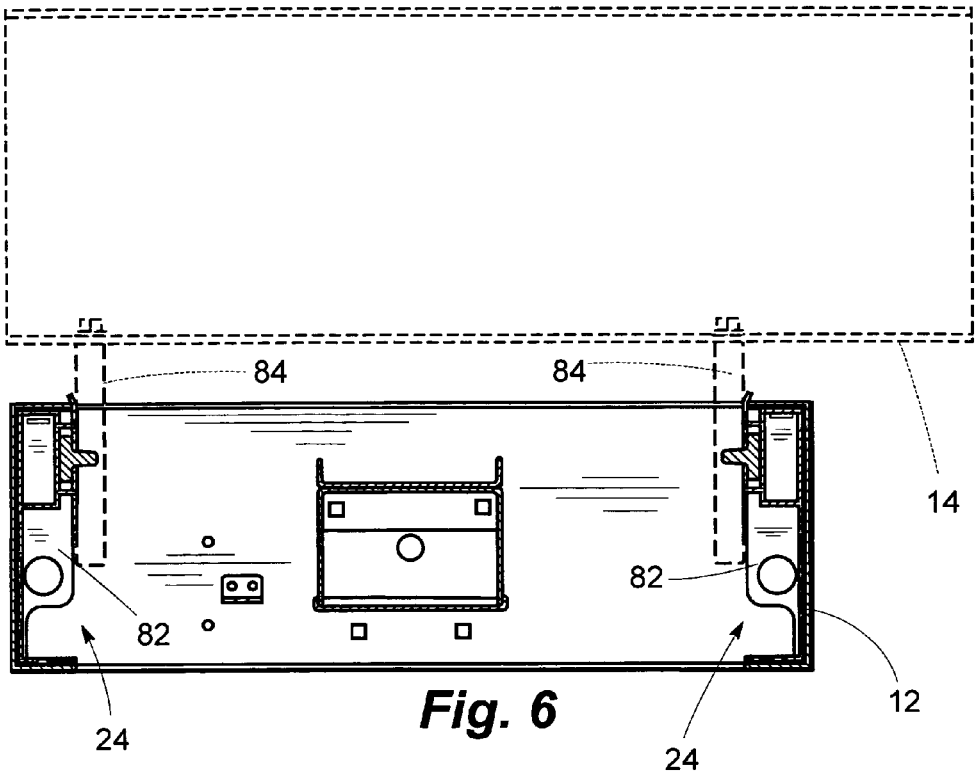
FIG. 6 is a detail view in section of a movable support frame of the lowering system of FIG. 2.
Figure 7A:
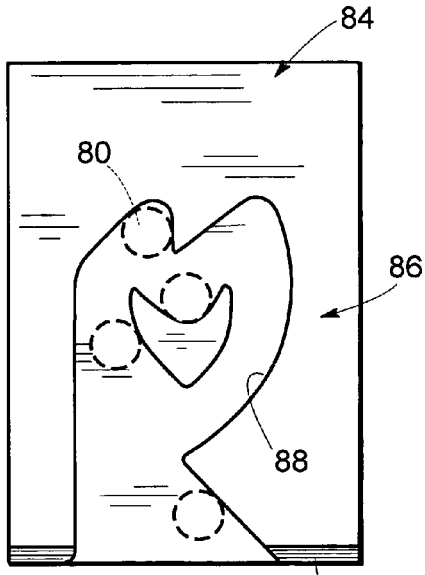
FIGS. 7A through 7C are detail views of a preferred latching mechanism used in the lowering system of the invention.
Figure 7B:
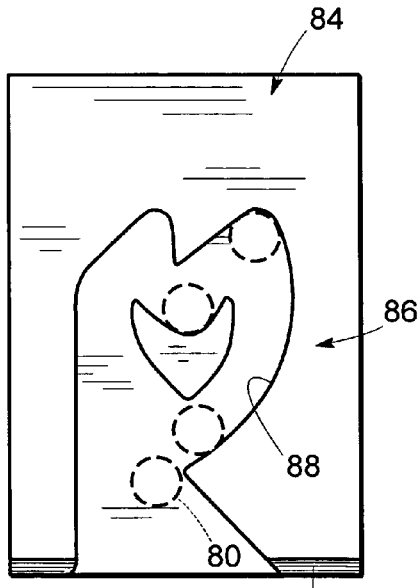
Figure 7C:
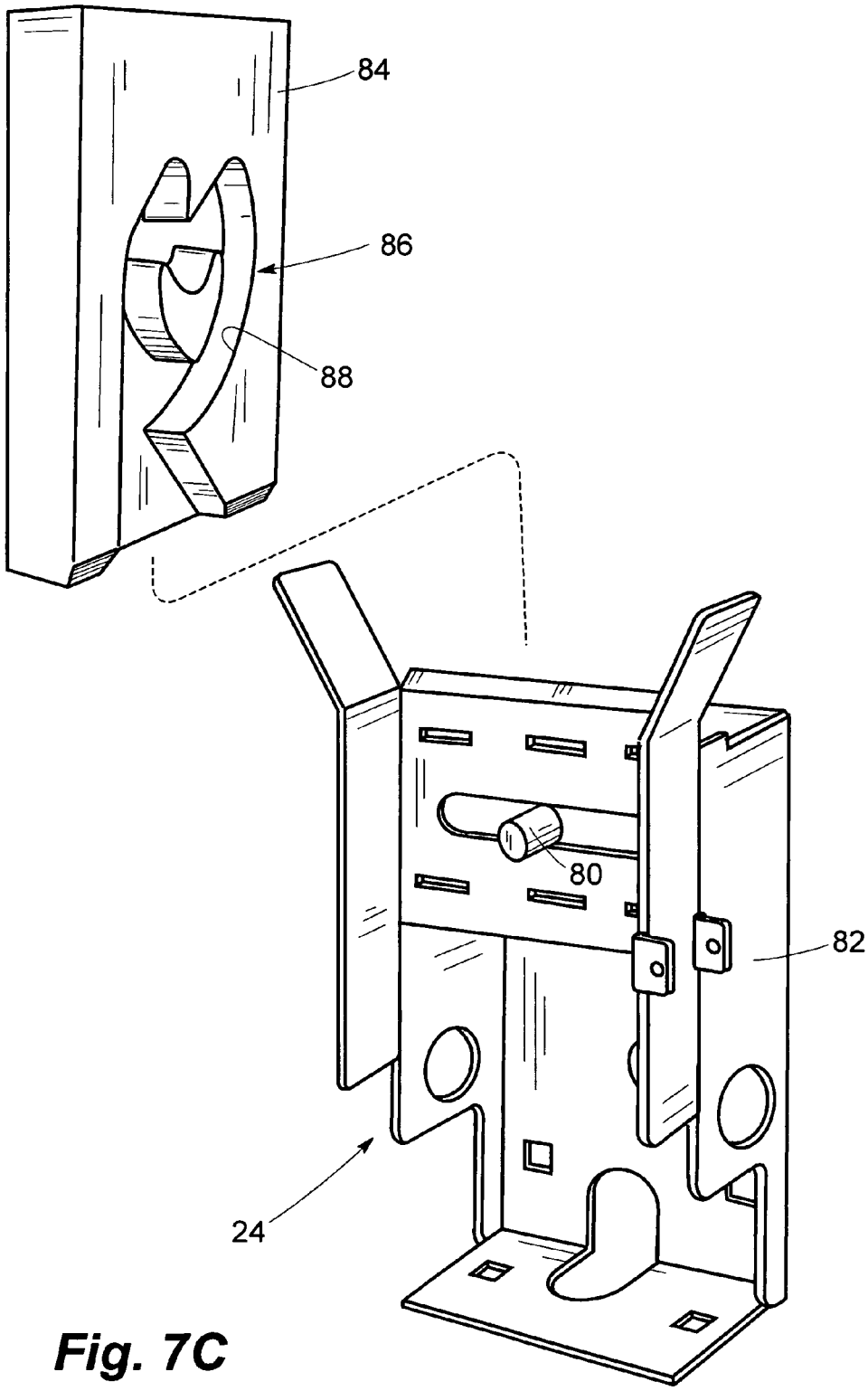

As is best seen in FIGS. 2 and 5, the movable support frame 12 is lowered from an "in use" location adjacent the stationary head frame 14 by a suitable number of wire cables 26 carried one each by respective pulleys 28 mounted conventionally within the head frame 14 on opposite ends thereof. The cables 26 extend from the pulleys 28 through an open lower face of the head frame 14 and attach to the movable support frame 12. The wire cables 26 enter the head frame 14 through an opening (not shown) in a side of the head frame 14 from a conduit 30 which houses the cables 26 between the head frame 14 and a fixed angle transition box 34.

Figure 4:
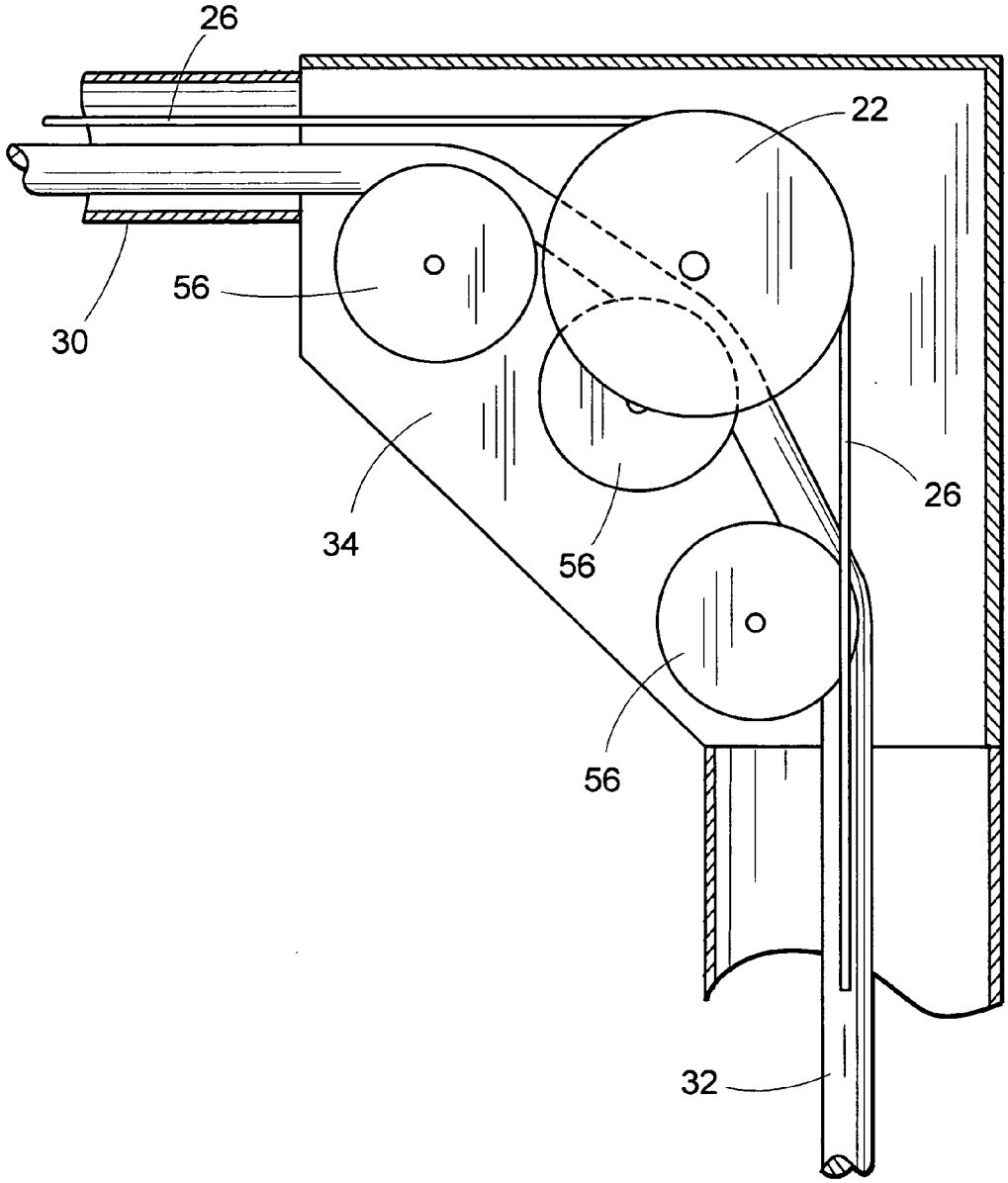
FIG. 4 is a detail view in section of a pulley and sheave arrangement of the lowering system of FIG. 2 used to change direction at a right angle.

A power cord 32 extends into the head frame 14 from the conduit 30 preferably through the same opening (not shown) in the head frame 14 and is carried by a power cord sheave arrangement 36 mounted in the head frame 14. The power cord 32 extends through the open face of the head frame 14 to a conventional attachment (not shown) in the movable support frame 12 for providing electrical power to the luminaires 16 (not shown in FIG. 2). As is also seen in FIG. 4, the power cord 32 is housed within the conduit 30 along with the wire cables 26, both the power cord 32 and the wire cables 26 extending into the transition box 34 through an opening therein (not shown), the power cord 32 and the wire cables 26 respectively being carried by an arrangement of sheaves 56 and a pulley 22 and change direction within the transition box 34 as seen in FIG. 4 to extend downwardly from and out of the box 34 through an opening (not shown) in the box 34 and into conduit 38 mounted on or in proximity to a wall 21 of the space within which the lowering system 10 is located for use. The lowering system 10 is seen in a conformation wherein a transition of 90° must be accommodated due to the geometric relationship of the ceiling 20 to the wall 21, that is, wherein the ceiling 20 is disposed at a right angle to the wall 21 in a conventional "flat" ceiling installation.

Figure 3:
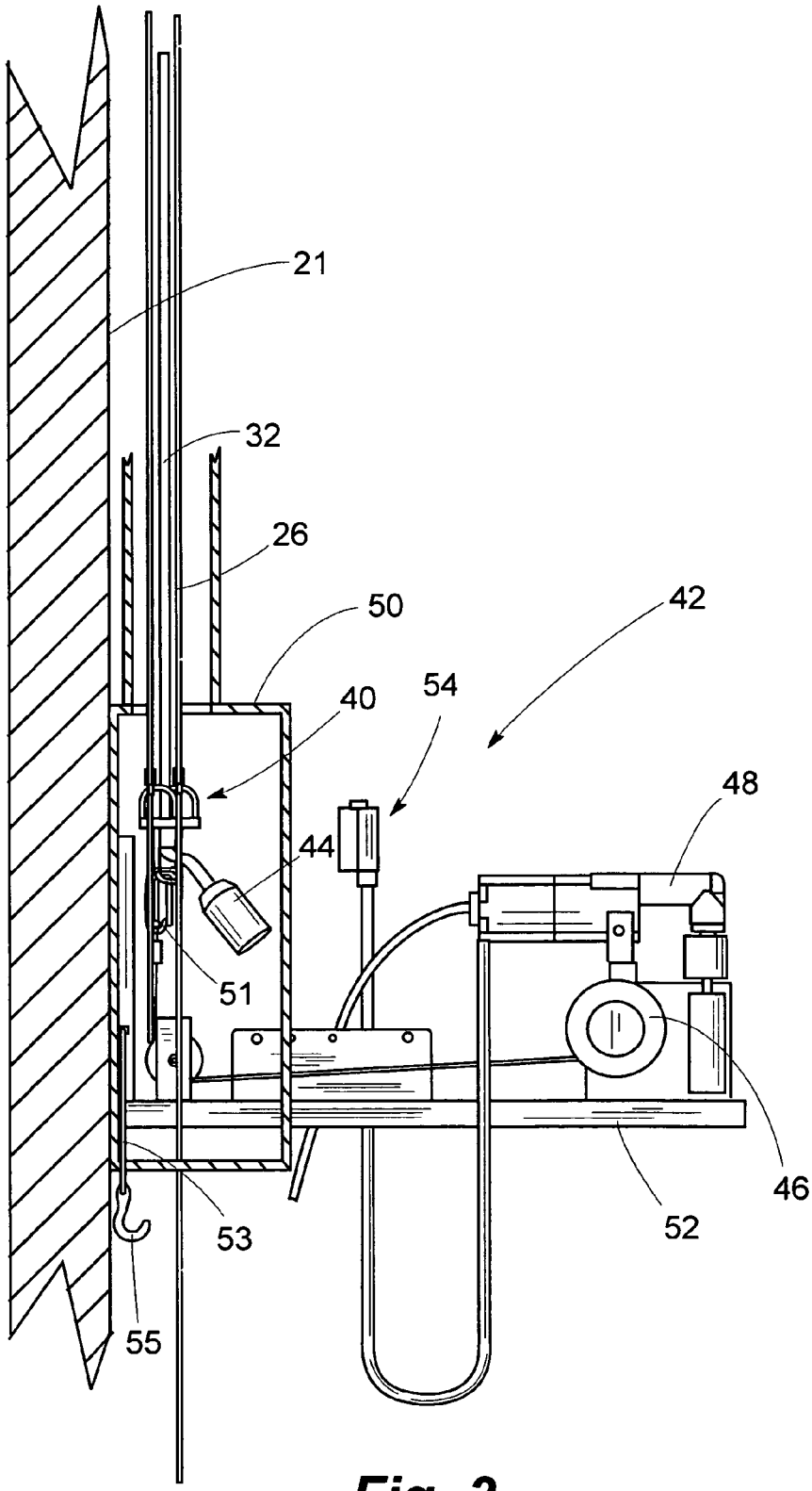
FIG. 3 is a detail view of a motive power arrangement used in certain embodiments of the lowering system such as is shown in FIG. 2.

As can best be seen in FIGS. 2 and 3, the cables 26 and the power cord 32 extend through the length of the conduit 38 and into operative engagement with powered apparatus used to lower and raise the support frame 12 by means of the cable wires 26. The conduit 38 is formed of a larger diameter than is the conduit 30 to allow housing of a clevis arrangement 40 to which the wire cables 26 connect. A winch and power unit 42 connects to the clevis arrangement 40 by means of a cable 41 and can be energized to lower and subsequently raise the luminaire-bearing support frame 12 for the purposes described herein. The clevis arrangement 40 also mounts a plug 44 terminating the power cord 32, the plug 44 being connectable to a source of power for operation of the luminaires 16. The clevis arrangement 40 connects to conventional mechanical expedients driven by a worm drive winch 46 operable by a motor 48, preferably an electric motor preferably in situations wherein an explosive atmosphere is not present. The motor 48 is conventionally operated by a manually-controlled reversing switch 54.

A support tray 52 is secured to a receiver box 50 (shown in section for ease of illustration) by means of a pin (not shown) when the system is in a raising/lowering configuration. The tray 52 mounts the winch and power unit 42, this structure being removable when not in use. When removed, a cover (not shown) can be placed over the box 50. In FIG. 3, the conduit 38 is shown removed for ease of illustration.

As best seen in FIGS. 2 and 3, a cable 53 having a hook 55 attached to a free end thereof is connected to the receiver box 50 for mating with clevis 51 of the clevis arrangement 40. Connection of the hook 55 to the clevis 51 occurs on removal of the winch and power unit 42 when the unit 42 is not in use. The cable 53 and hook 55 performs a safety function.

Referring again to FIG. 5, the pulleys 28 respectively function to each carry one each of the wire cables 26 that extend from the head frame 14 and connect to the support frame 12 so that the support frame 12 can be raised and lowered on operation of the motor 48. The power cord 32 is carried by sheaves 59 of the power cord sheave arrangement 36, the cord 32 extending to the support frame 12 and electrically connecting to the luminaires 16 to provide power thereto as previously noted. Although not configured for such function as shown in FIG. 5, the power cord 32 can be paid out as the support frame 12 is lowered to continue electrical power, if desired, to the luminaires 16 during raising and lowering of the luminaire-bearing support frame 12. The pulleys 28 and the sheaves 59, as well as the pulley 22 and sheaves 56 mounted for function within the box 34, are mounted conventionally for rotational movement.

Referring now to FIGS. 6 and 7A through 7C, the latching assembly 24 is seen to be comprised of a latch pin 80 mounted for sliding movement within a pin housing 82, the pin housing 82 being carried by the support frame 12. The latching assembly 24 is further comprised of a cam latch plate 84 mounted to the stationary head frame 14. A camming pattern 86 is formed in the latch plate 84, the pattern 86 being recessed into the plate 84. On engagement of the latch pin 80 with the latch plate 84, the pin 80 engages camming surfaces 88 of the camming pattern 86 formed in the latch plate 84 and follows the pattern 86 on upward movement of the support frame 12 relative to the stationary head frame 14. The support frame 12 thus latches to the head frame 14 through the agency of the latching assembly 24, the structure and operation of the latching assembly being described in detail in U.S. patent application Ser. No. 11/120,449, filed May 4, 2005, of which the present patent application is a continuation-in-part and the disclosure of which is incorporated hereinto by reference. The latching assembly 24 permits unlatching of the support frame 12 from the stationary head frame 14 for lowering of the support frame 12 for purposes noted herein.

Figure 8A:
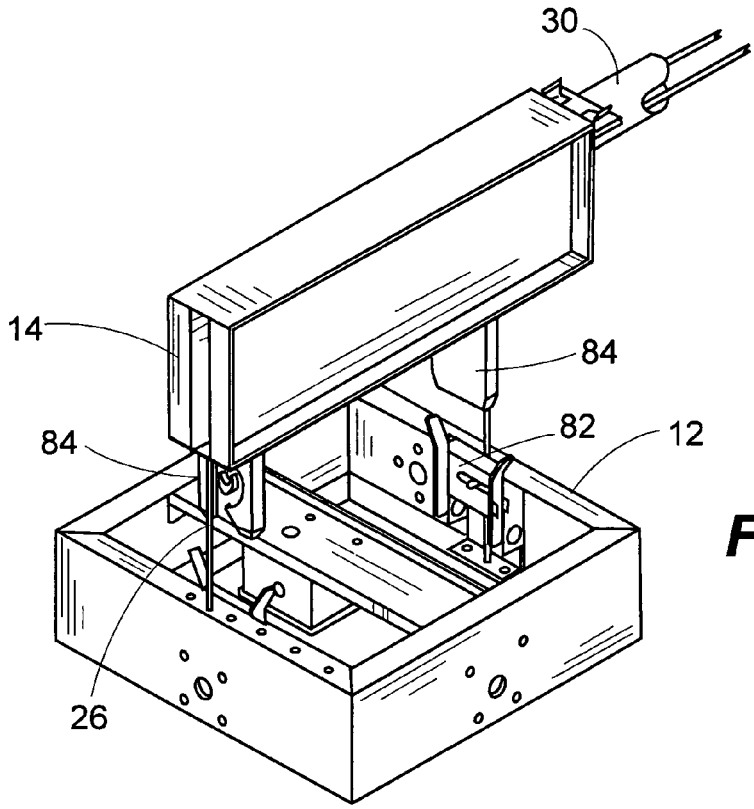
FIGS. 8A and 8B are perspective views illustrating mounting of respective portions of the latching mechanism of FIGS. 7A through 7C to the movable support frame and to the stationary head frame.
Figure 8B:
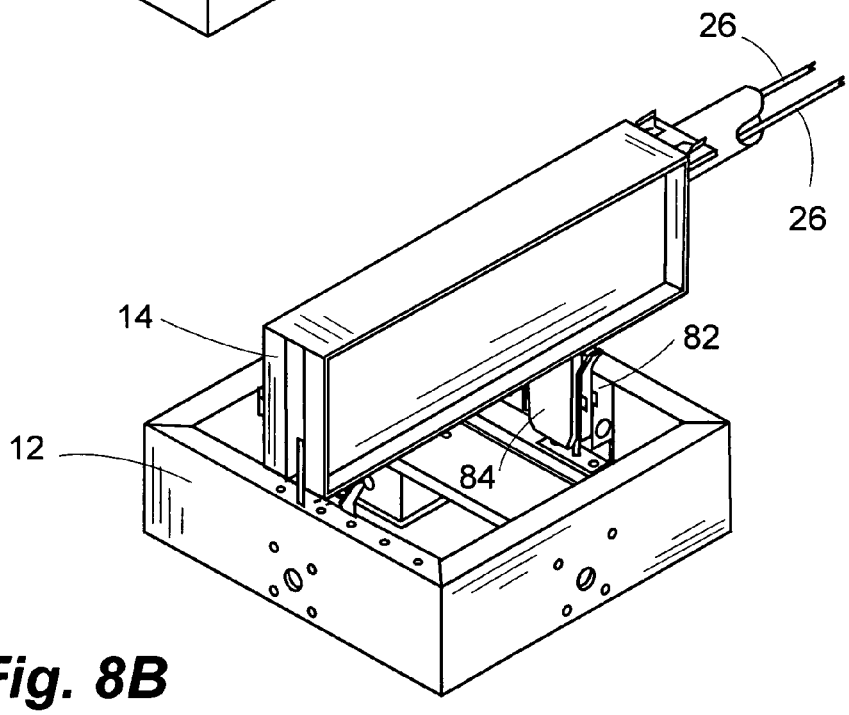
Figure 9:
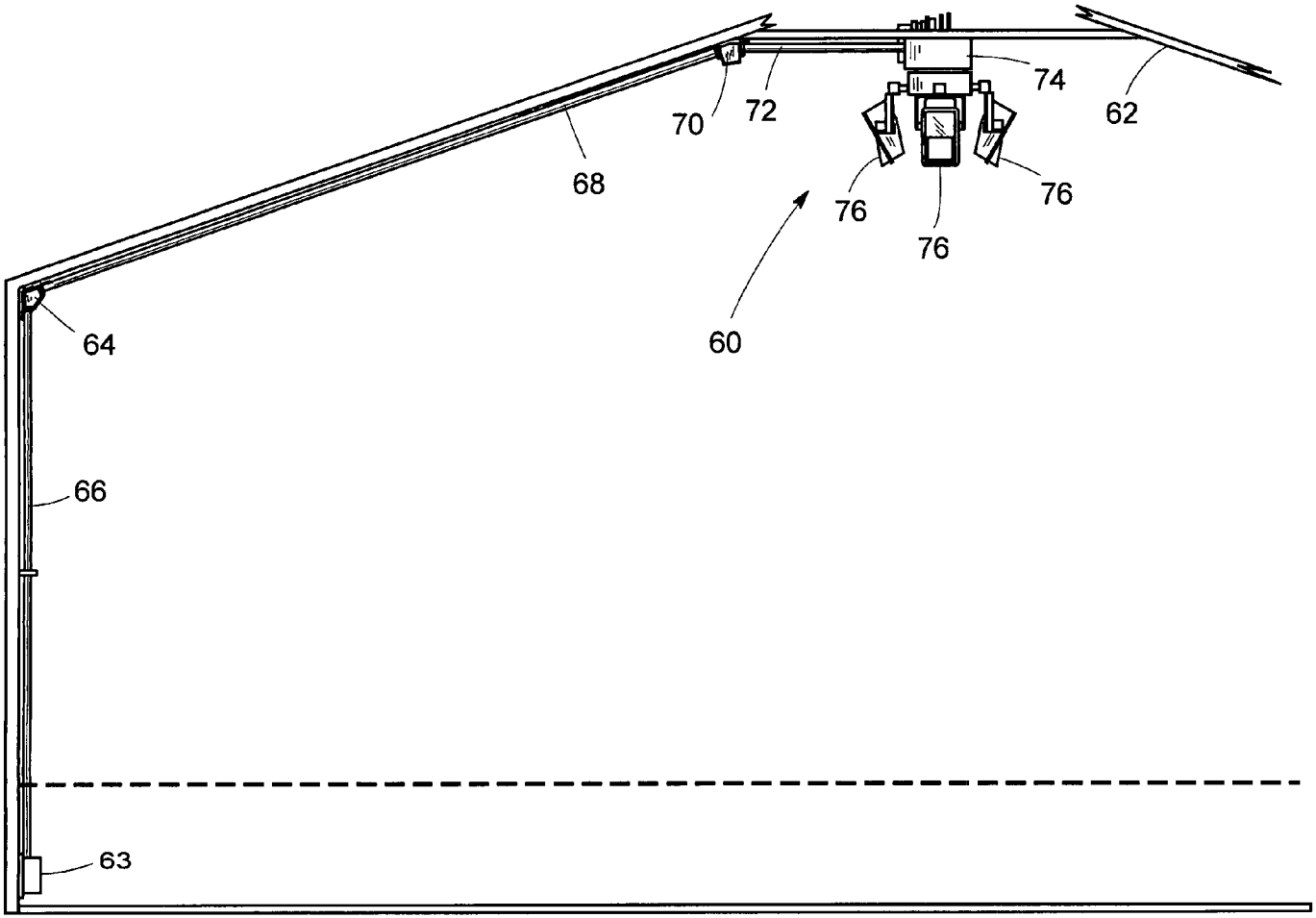

As seen best in FIGS. 8A and 8B, the pin housing 82 within which the latch pin 80 is capable of sliding movement is mounted to the support frame 12 while the latch plate 84 is mounted to the head frame 14. Two of the latching assemblies 24 are preferably used to releasably latch the support frame 12 to the head frame 14, the two assemblies 24 acting in concert to provide latching and unlatching functions. As can be appreciated in light of the intended scope of the invention, latching assemblies other than the latching assembly 24 can be employed to accomplish the latching and unlatching functions necessary to practice of the invention. In FIG. 8A, the latching assemblies 24 are shown in the unlatched configuration while FIG. 8B shows the latching assemblies 24 in a latched configuration.

FIGS. 9 and 10A through 10D illustrate a lowering system 60 particularly usable in hazardous environments such as in a petrochemical plant wherein gases and other combustible material present an explosion hazard in the event of a spark from an electrical appliance such as an electrical motor. In such situations, an air motor (not shown) is used in place of the motor 48 of FIG. 1. The lowering system 60 is seen to be located in an installation wherein ceiling 62 is vaulted, transition box 64 therefore being configured to provide a transition between conduits 66 and 68 of greater than 90°. A transition box 70 is provided at the end of the conduit 68 to permit location of a horizontal conduit 72 that extends to stationary head frame 74 mounted to building structure, the head frame 74 being oriented horizontally and being releasably joinable to a movable support frame 76, the head frame 74 and the support frame 76 being essentially identical to the head frame 14 and the support frame 12 shown in FIG. 1. The lowering system 60 through agency of the fixed angle transition boxes 64 and 70 permit installation in a situation wherein the ceiling 62 is an angled ceiling.

Figure 10A:
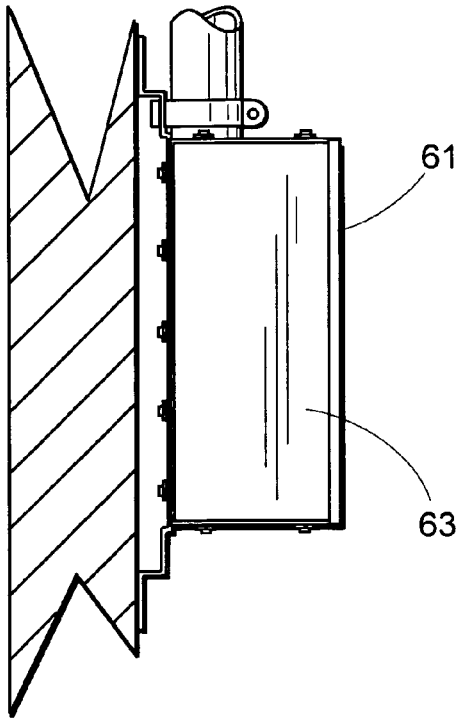
FIGS. 10A through 10D are detail elevational views of portions of the lowering system of FIG. 9.
Figure 10B:
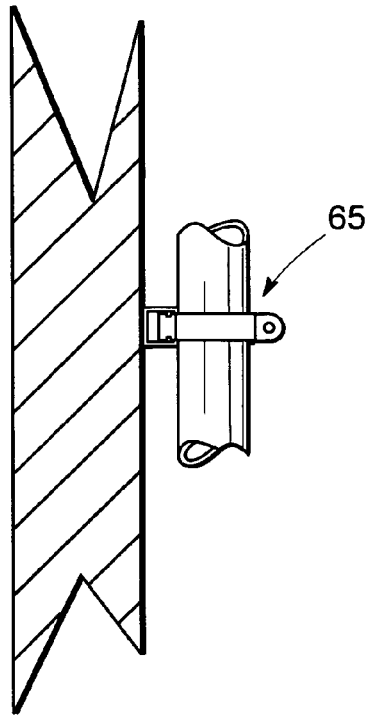
Figure 10C:
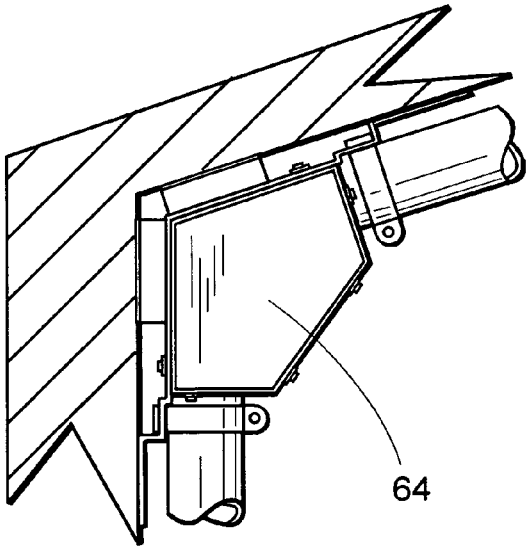
Figure 10D:
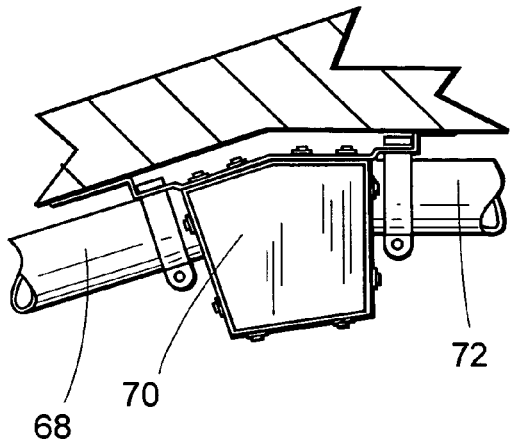

The boxes 64 and 70 seen best in FIGS. 10C and 10D respectively can be configured to be air-tight, if necessary, to negate the destructive effect of any spark generated by passage of wire cables (not shown in FIGS. 10C and 10D) over sheaves and/or pulleys (not shown) contained within said boxes 64 and 70. Housing 63 seen in FIG. 10A has a housing cover 61 that opens to expose a winch and power arrangement (not shown) to include an air motor or the like. FIG. 10B illustrates a mounting arrangement 65 for maintaining the conduit 66 in place.

Figure 11A:
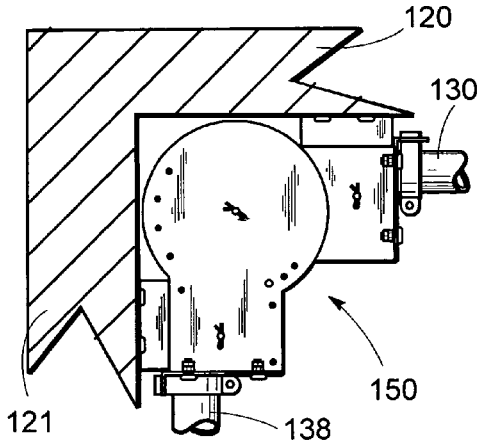
FIGS. 11A through 11C are detail views of a variable angle transition capable of accommodating ceiling surface conformations of differing configuration.
Figure 11B:
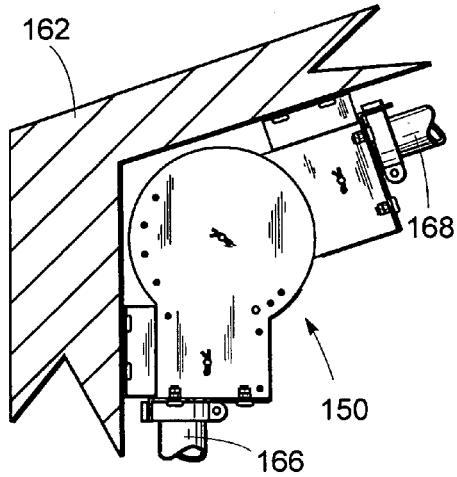
Figure 11C:
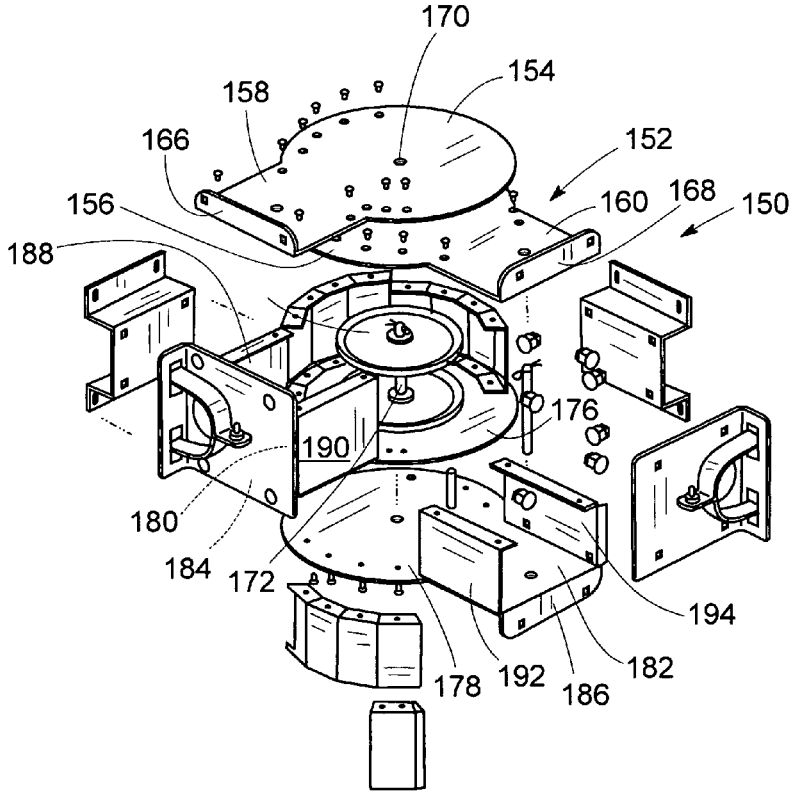
Figure 12:
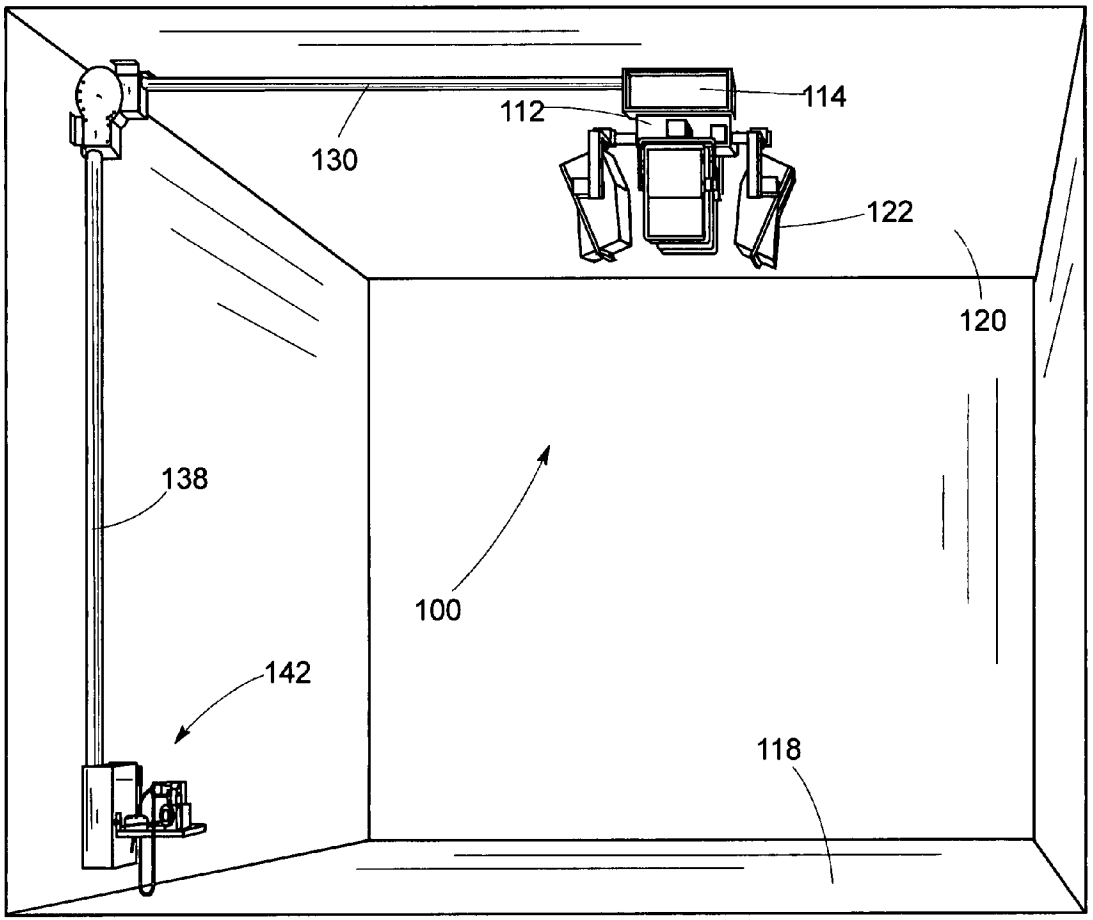
FIG. 12 is a perspective view of a lowering system including the variable angle transition of FIGS. 11A through 11C.
Figure 13:
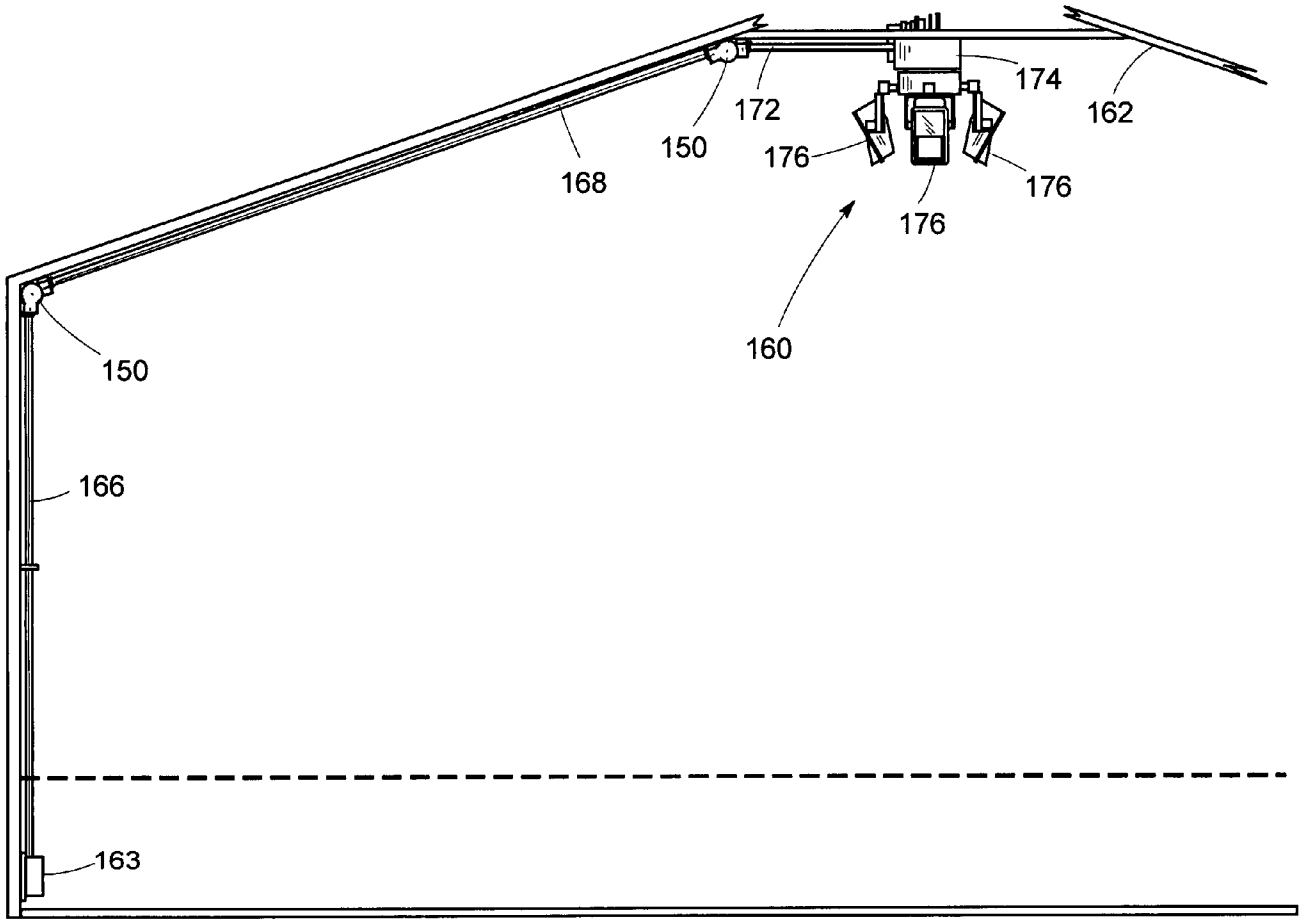
FIG. 13 is a side elevational view of an installation having a sloped ceiling; and, FIG. 14 is a side elevational view in partial section and partially cut-away of the transition of FIGS. 11A through 11C.
Figure 14:
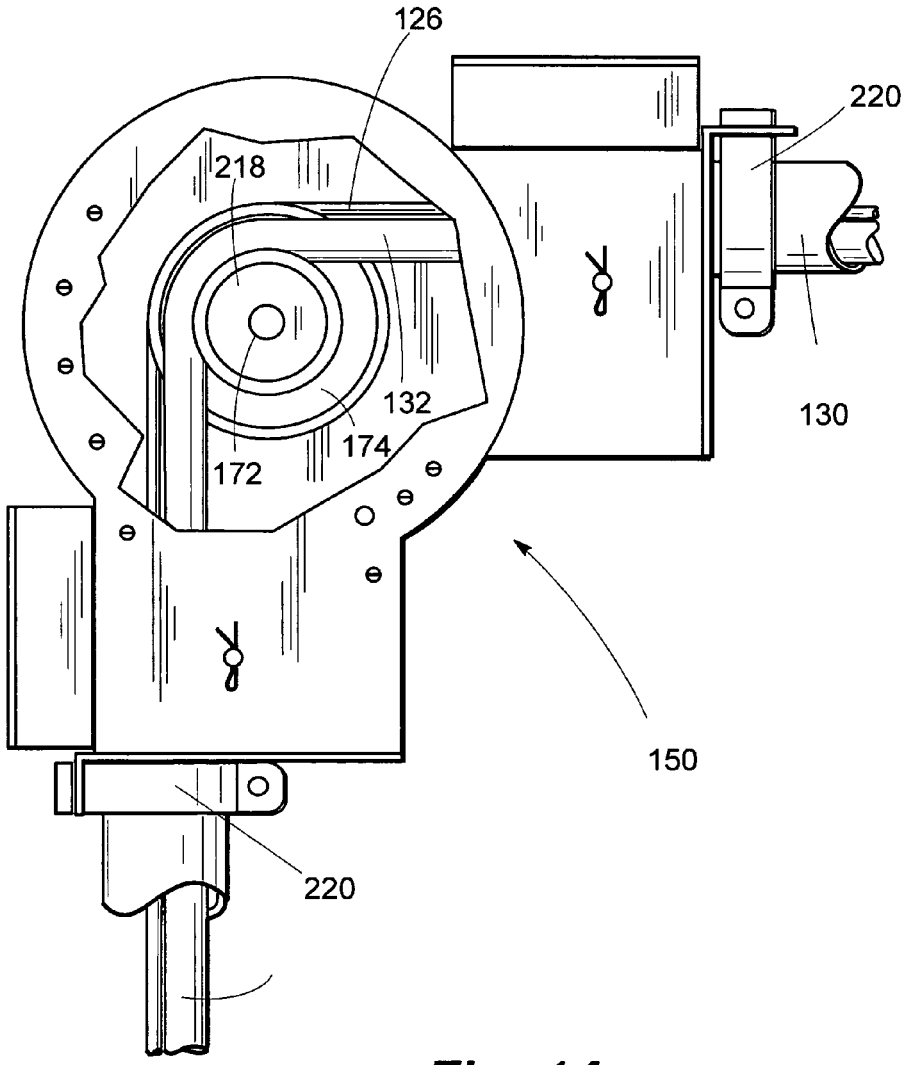

Referring now to FIGS. 11A through 11C, and 12 through 14, a lowering system 100 is seen in FIGS. 12 and 13 to be installable in situations including flat ceilings such as ceiling 120 of FIG. 12 and angled ceilings such as ceiling 162 of FIG. 13. A variable angle transition box 150 can be seen in each of the FIGS. 11A through 11C and 12 through 14, the box 150 being seen in FIGS. 11A, 12 and 14 in a configuration wherein a 90° transition is required due to a flat ceiling 120. In FIGS. 11B and 13, the box 150 is configured to accommodate sloped ceiling 162. FIG. 11C illustrates the structure of the transition box 150 that permits accommodation of essentially any angled ceiling ordinarily encountered in conventional buildings.

Referring first to FIG. 11C, the transition box 150 is formed of a housing seen generally at 152 to be formed of upper plates 154 and 156 mounted for rotation relative to each other, the plates 154 and 156 forming one side of the housing 152. The plates 154 and 156 each have substantially circular base elements 158 and 160 respectively and respective extensions 162 and 164 each having flanges 166 and 168 extending outwardly from free ends of the extensions 162 and 164. The plates 154 and 156 are mounted to pivot relative to each other about a central axis formed by a central pin 172 that also mounts pulley sheaves 174 for rotation within the box 150. The pin 172 also mounts lower plates 176 and 178 for pivotal movement relative to each other in concert with pivoting movement of the upper plates 154 and 156. The lower plates 176 and 178 are each provided with respective extensions 180 and 182 which have flanges 184 and 186 respectively extending outwardly from free ends thereof. The extensions 180 and 182 are each further provided with opposing walls 188, 190 and 192, 194, each of the walls 188, 190, 192 and 194 having inwardly extending flanges 196, 198, 200 and 202 formed on upper free edges thereof. End plates 204 and 206 respectively join to respective ends of the joined upper plates 154, 156 and lower plates 176, 178 to enclose said ends. Curved walls 208, 210 and 212, preferably segmented for ease of manufacture and operation, act to enclose annular regions about the periphery of the box 150 at those locations not enclosed by the walls 188, 190, 192 and 194 of the lower plates 192 and 194. The curved walls 208, 210 and 212 slide relative to the plates 154, 156 and 192, 194 on pivotal movement thereof to configure the box 150 to accommodate angled ceilings from at least 90° as seen in FIG. 12 to obtuse angles as seen in FIG. 13. A single transition box 150 therefore accommodates differing angles as is necessary to configure particular ceiling installations.

As best seen in FIG. 11C, the end plates 204 and 206 have openings 214 and 216 formed respectively therein to receive conduits such as the conduits 130, 138 or conduits 166, 168, 172 through which cable wires 126 and a power cord 132 extend into the interior of the box 150 to thread respectively over a pulley 174 and a sheave arrangement 218 as has been described herein relative to other embodiments of the invention. Mounts 220 connect the conduits 130, 138 or conduits 166, 168, 172 to the box 150 and to walls. The lowering systems 100 and 160 are driven by apparatus such as has been described herein relative to the lowering systems 10 and 60.

Although the lowering systems of the invention have been described relative to particular embodiments thereof, it is to be understood that the invention can be embodied other than as expressly shown and described herein, the scope of the invention being defined by the appended claims.

What is claimed is:

1. A latching mechanism useful in a hoisting system wherein a support base latches to a stationary structure on movement of the support base into juxtaposition with the stationary structure, the improvement comprising:

at least one latch plate carried by the stationary structure and having a camming pattern formed on a surface of the latch plate;

a latch pin engageable with the camming pattern on movement of the support base relative to the stationary structure; and, slide means carried by the support base and movable relative thereto for mounting the latch pin, the slide means being displaceable laterally relative to the support base to permit lateral movement of the latch pin on engagement with the camming pattern.

2. A hoisting system operable within a building structure having a ceiling for lowering a device requiring maintenance, repair or replacement from an "in use" position at or near the ceiling to a maintenance position at or near a floor of the building structure below the "in use" position, comprising:

first means fixed to the ceiling;

second means movable relative to the first means for supporting the device for movement relative to the ceiling from the "in use" position to a maintenance position;

at least one latch plate carried by the first means and having a camming pattern formed thereon;

a latch pin engageable with the camming pattern on movement of the second means relative to the first means; and, slide means carried by the second means for only lateral movement relative to the second means and for mounting the latch pin for movement relative to the second means, the slide means being displaceable laterally relative to the second means to permit lateral movement of the latch pin on engagement with the camming pattern to latch the second means to the first means.

3. The hoisting system of claim 2 wherein the device is mounted in suspended, recessed or surface-mounted relation to the ceiling.

4. The hoisting system of claim 2 wherein the device comprises at least one luminaire.

5. The hoisting system of claim 2 wherein the camming pattern is shaped to permit movement of the latch pin from engagement with the camming pattern on upward movement of the second means relative to the ceiling when the second means is latched to thereby unlatch the second means from the first means to permit lowering of the second means and the device mounted thereto for maintenance, repair or replacement of the device.

6. The hoisting system of claim 2 and further comprising motive means disposed remotely from the ceiling at a location accessibly from the floor for actuation of the second means to lower the device for operation thereon and for raising the device to the "in use" position.

7. The hoisting system of claim 6 wherein the building structure has at least one wall, the motive means being disposed on an interior face, an exterior face or within the wall.

8. The hoisting system of claim 6 wherein the motive means comprises a motor.

9. The hoisting system of claim 8 wherein the motor comprises an air motor.

10. The hoisting system of claim 6 wherein the motive means comprises at least one cable attached to the supporting means and a winch displacing the cable.

11. The hoisting system of claim 10 wherein the motive means further comprises a motor operably joined to the winch to operate the winch.

12. The hoisting system of claim 10 and further comprising a power cord connected to the device to supply power to the device, the power cord extended from the device to the motive means.

13. The hoisting device of claim 12 and further comprising means for housing the cable and power cord.

14. The hoisting device of claim 13 and further comprising means for providing a directional transition of the cable and of the power cord.

15. The hoisting system of claim 6 and further comprising:

means for mounting the supporting means and the motive means to or relative to ceilings of any conventional angle.

16. A hoisting system operable within a building structure having a ceiling for lowering a device requiring maintenance, repair or replacement from an "in use" position at or near the ceiling to a maintenance position at or near a floor of the building structure below the "in use" position, comprising:

first means fixed to the ceiling;

second means movable relative to the first means for supporting the device for movement relative to the ceiling from the "in use" position to a maintenance position;

means carried by the second means for latching to the first means, the latching means comprising a latch assembly carried by the second means and having a latch pin and a housing means for housing the latch pin, the housing means having a slot formed therein through which the latch pin extends and is displaceable within the slot, and slide means movable within the housing means for mounting the latch pin, the slide means being displaceable laterally within the housing means to permit lateral movement of the latch pin relative to the second means; and, means carried by the first means for engaging the latching means carried by the second means to latch the second means to the first means.

17. The hoisting system of claim 16 wherein the engaging means comprises at least one latch plate having a camming pattern formed on the latch plate, the latch pin being movable laterally to engage the camming pattern on raising of the second means into adjacent relation to the first means.

18. A hoisting system operable within a building structure having a ceiling for lowering a device requiring maintenance, repair or replacement from an "in use" position at or near the ceiling to a maintenance position at or near a floor of the building structure below the "in use" position, comprising:

first means fixed to the ceiling;

second means movable relative to the first means for supporting the device for movement relative to the ceiling from the "in use" position to a maintenance position;

a latching mechanism comprising at least one latch plate carried by the first means and having a camming pattern disposed on the plate, and further comprising a latch pin carried by the second means and engageable with the camming pattern on movement of the second means relative to the first means to adjacent relation therewith; and, slide means carried by the second means and movable relative to the second means for mounting the latch pin for displacement laterally of the second means on engagement with the camming pattern.

19. The hoisting system of claim 18 and further comprising motive means disposed remotely from the ceiling at a location accessibly from the floor for actuation of the second means to lower the device for operation thereon and for raising the device to the "in use" position.

* * * * *